US006698319B2

(12) United States Patent
Huang

(10) Patent No.: US 6,698,319 B2
(45) Date of Patent: Mar. 2, 2004

(54) TOOL RETAINING DEVICE FOR RETAINING VARIOUS TOOLS

(76) Inventor: Li Shiu Huang, P.O. Box 63-99, Taichung (TW), 406

( * ) Notice: Subject to any disclaimer, the term of this patent is extended or adjusted under 35 U.S.C. 154(b) by 137 days.

(21) Appl. No.: 10/061,265

(22) Filed: Feb. 4, 2002

(65) Prior Publication Data

US 2003/0145693 A1 Aug. 7, 2003

(51) Int. Cl.[7] ..... B25B 23/00
(52) U.S. Cl. ..... 81/438; 81/439
(58) Field of Search ..... 81/436–439, 442, 81/444, 445, 447–449, 451, 460

(56) References Cited

U.S. PATENT DOCUMENTS 2,671,484 A * 3/1954 Clark ..... 81/451
5,012,708 A * 5/1991 Martindell ..... 81/429
5,400,681 A * 3/1995 Strauch ..... 81/177.2
5,724,873 A * 3/1998 Hillinger ..... 81/451
5,934,384 A * 8/1999 Wang ..... 173/132
5,938,212 A * 8/1999 Wadsworth ..... 279/42
5,954,463 A * 9/1999 Jore ..... 408/239 R
5,992,274 A * 11/1999 Lammers ..... 81/451
6,499,168 B1 * 12/2002 Anderson ..... 7/165
6,530,299 B1 * 3/2003 Liu ..... 81/451

* cited by examiner

*Primary Examiner*—Joseph J. Hail, III
*Assistant Examiner*—David B. Thomas

(57) ABSTRACT

A tool retaining device includes a shank having two ends selectively engaged in a barrel and having tool members detachably secured to the ends for being selectively used to act onto the objects or to drive fasteners. The shank includes an end shaft having a socket opening for receiving a tool member, a bucket secured onto the shaft and having a bore for slidably receiving a casing. A magnetic member is engaged in the casing and includes an orifice for slidably receiving the tool member and for attracting and retaining the tool member to the shaft.

14 Claims, 4 Drawing Sheets

TOOL RETAINING DEVICE FOR RETAINING VARIOUS TOOLS

BACKGROUND OF THE INVENTION

1. Field of the Invention

The present invention relates to a tool retaining device, and more particularly to a tool retaining device for retaining or coupling various tool members to power driving tool and to be changeably driven by the power driving tool.

2. Description of the Prior Art

Typical tools or tool members are required to be attached to or coupled to the power driving tools and to be driven by the power driving tools, without various kinds of tool retaining devices. However, the typical tool retaining devices each may only be used for attaching a single tool or tool member to the power driving tools. The typical tool retaining devices may not be used for changeably securing or attaching different or various kinds of tools or tool members to the power driving tools.

The present invention has arisen to mitigate and/or obviate the afore-described disadvantages of the conventional tool retaining devices.

SUMMARY OF THE INVENTION

The primary objective of the present invention is to provide a tool retaining device for retaining or coupling various tool members to power driving tool and to be changeably driven by the power driving tool.

In accordance with one aspect of the invention, there is provided a tool retaining device comprising a shaft including a first end having a socket opening formed therein, a first tool member attached to the socket opening of the shaft, a bucket including a first end secured to the shaft and including a bore formed therein, and including a second end, the first tool member being received in the bore of the second end of the bucket, a casing slidably received in the second end of the bucket, and including a magnetic member engaged therein, and including an orifice formed therein for slidably receiving the first tool member, the first tool member being slidably engaged through the magnetic member and the casing and extendible outward of the casing, and means for biasing the casing away from the bucket.

The bucket includes a peripheral flange extended radially inward from the second end thereof, the casing includes a peripheral rib extended radially outward therefrom for engaging with the peripheral flange of the bucket and for limiting a movement of the casing relative to the bucket and for preventing the casing from being disengaged from the bucket.

The shaft includes a second magnetic member engaged in the socket opening thereof for retaining the first tool member to the shaft.

The shaft includes an outer thread formed thereon, the bucket includes an inner thread threaded with the outer thread of the shaft, and a lock nut threaded onto the shaft and engaged with the bucket for locking the bucket to the shaft.

A barrel is further provided, a shank includes two ends selectively engaged in the barrel and includes the shaft extended from a first end thereof, and means for detachably securing the shank to the barrel.

The shank includes an outer peripheral recess formed therein, the detachably securing means includes a ball slidably received in the barrel, and means for forcing the ball to engage with the outer peripheral recess of the shank.

The forcing means includes a ferrule slidably engaged onto the barrel and engageable with the ball for forcing the ball to engage into the barrel and to engage with the outer peripheral recess of the shank.

A device is further provided for biasing the ferrule to engage with the ball and to force the ball to engage with the shank.

The shank includes a second end having a conduit extended thereon, the conduit includes an orifice formed therein, the tool retaining device further includes a second tool member engaged in the orifice of the conduit for being attached to the shank.

The shank includes a second magnetic member engaged in the conduit for retaining the second tool member to the shank.

A device is further provided for detachably securing the second tool member to the conduit, and includes a spring catch having a tongue slidably received in and engaged through the conduit, and means for forcing the tongue to engage with the second tool member.

The forcing means includes a sleeve slidably engaged onto the conduit and engageable with the spring catch for forcing the tongue to engage into the conduit and to engage with the second tool member.

The sleeve includes an actuator engageable with the spring catch for forcing the tongue to engage into the conduit and to engage with the second tool member.

A device may further be provided for biasing the actuator of the sleeve to engage with the tongue and to force the tongue to engage with the second tool member.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
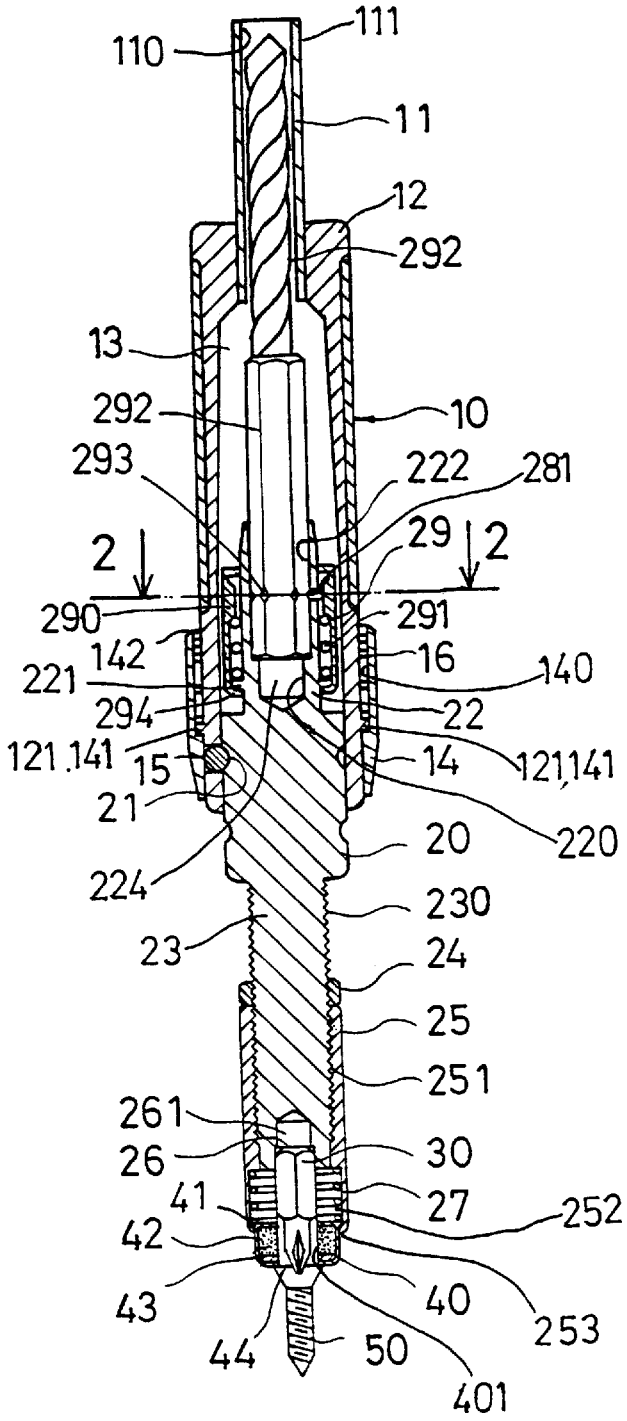
FIG. 1 is a cross sectional view taken along lines 1—1 of FIG. 2, illustrating a tool retaining device in accordance with the present invention.
Figure 2:
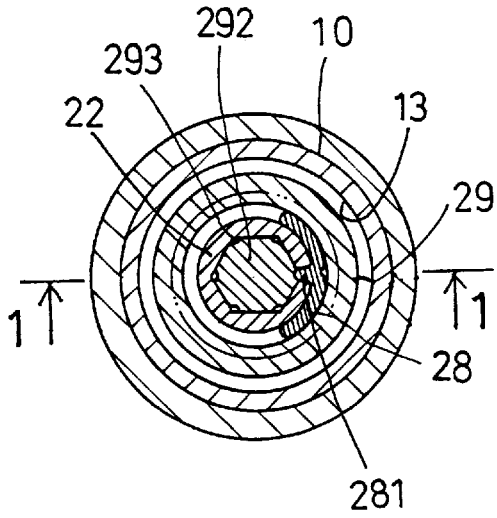
FIG. 2 is a cross sectional view taken along lines 2—2 of FIG. 1.
Figure 4:
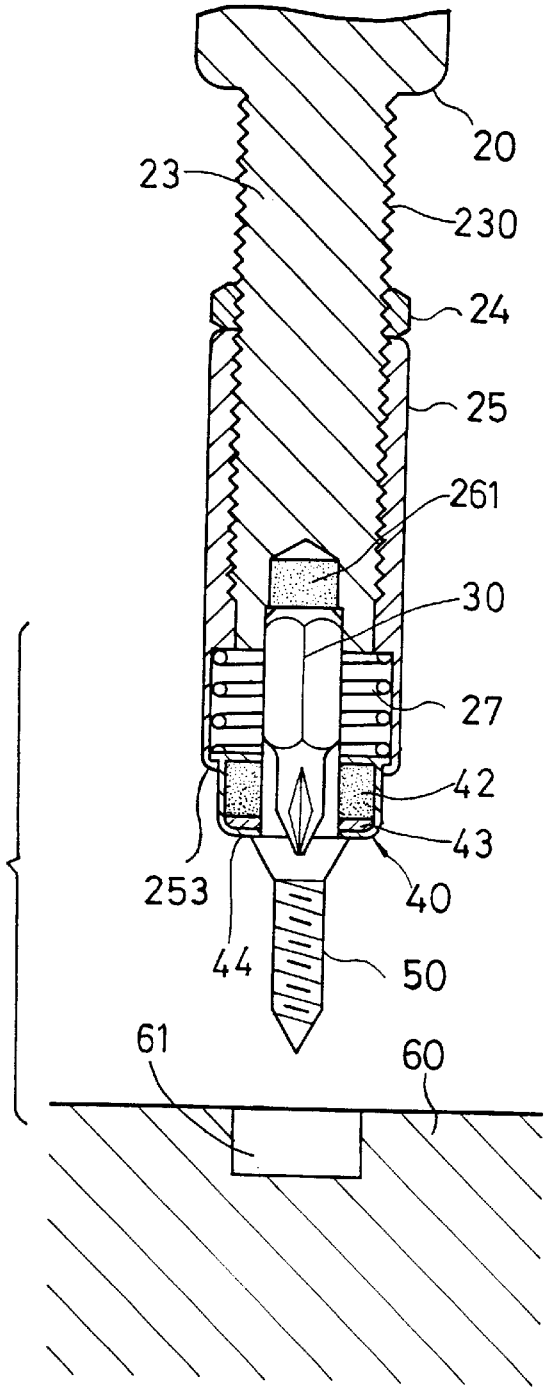
FIGS. 4, 5, 6, 7 are enlarged partial cross sectional views similar to FIG. 3, illustrating the operation of the tool retaining device.
Figure 3:
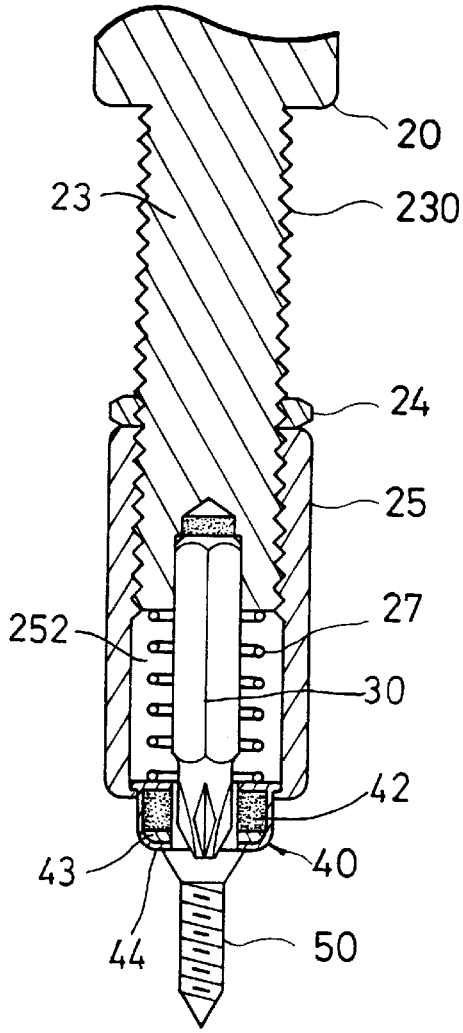
FIG. 3 is an enlarged partial cross sectional view illustrating the operation of the tool retaining device.

Referring to the drawings, and initially to FIGS. 1 and 2, a tool retaining device in accordance with the present invention is generally indicated with a reference numeral "10" and comprises a duct 11 secured or extended from one end of a barrel 12 and having a bore 110 formed therein for receiving tools or tool member 292, such as the drilling member 292, and having one end 111 for coupling to the power driving tools and to be driven by the power driving tools. The barrel 12 includes a chamber 13 formed therein, and includes a peripheral rib or stop 121 extended radially outward from the other end thereof.

A shank 20 includes two ends selectively engageable into the barrel 12, and includes one or more peripheral recesses 21 formed in the middle portion thereof. A ball 15 is engaged in the other end of the barrel 12 for selectively engaging into the peripheral recess 21 of the shank 20 and for detachably securing the shank 20 to the barrel 12. A ferrule 14 is slidably engaged onto the other end of the barrel 12, and engageable with the ball 15 for forcing the ball 15 into the peripheral recess 21 of the shank 20 and for detachably securing the shank 20 to the barrel 12. The ferrule 14 includes a bore 140 and a peripheral shoulder 141 formed therein for engaging with the peripheral stop 121 of the barrel 12 and for limiting the sliding movement of the ferrule 14 relative to the barrel 12. A spring 16 is engaged in the ferrule 14 and engaged with a peripheral rib 142 of the ferrule 14 for biasing the ferrule 14 to engage with the peripheral stop 121 of the barrel 12 and for forcing the ferrule 14 to engage the ball 15 into the peripheral recess 21 of the shank 20 and for detachably securing the shank 20 to the barrel 12.

In order to remove the shank 20 from the barrel 12, it is only required to move the ferrule 14 relative to the barrel 12 against the spring 16, until the ball 15 is received in the bore 140 of the ferrule 14. The ball 15 may thus be disengaged from peripheral recess 21 of the shank 20 such that the shank 20 may be detached and disengaged from the barrel 12. The shank 20 may be changed to engage different ends into the chamber 13 of the barrel 12, and to have the required tool members extended outward of the barrel 12. The other shanks 20 may also be changeably and selectively attached to the barrel 12 for attaching the other tool members to the barrel 12.

The shank 20 includes a conduit 22 extended from one end thereof and having an orifice 222 formed therein for receiving the tools or tool members 292, such as the drilling members 292, and includes a cavity 220 formed therein for receiving such as a magnetic attracting member 224 therein for attracting and securing the tool member 292 in the conduit 22. The conduit 22 includes a peripheral flange 221 extended radially outward from one end thereof, closer to the root portion thereof or closer to the conduit 22. A spring catch 28 includes a tongue 281 engaged through the conduit 22 and engaged into the orifice 222 of the conduit 22 for selectively engaging into the peripheral recess or depression 293 of the tool member 292 and for detachably securing the tool member 292 to the conduit 22.

A sleeve 29 is slidably engaged onto the conduit 22 and includes an actuator 290 engageable with the tongue 281 of the spring catch 28 for forcing the tongue 281 of the spring catch 28 into the tool member 292 and for detachably securing tool member 292 to the conduit 22. The sleeve 29 includes a peripheral flange 294 for engaging with the peripheral flange 221 of the conduit 22 and for limiting the sliding movement of the sleeve 29 relative to the conduit 22. A spring 291 is engaged between sleeve 29 and the peripheral flange 221 for biasing the actuator 290 to engage with the spring catch 28 and to engage the tongue 281 of the spring catch 28 into the tool member 292 for detachably securing the tool member 292 to the conduit 22.

In order to remove the tool member 292 from the conduit 22, it is only required to move the sleeve 29 relative to the conduit 22 against the spring 291, until the tongue 281 of the spring catch 28 is disengaged from the tool member 292 such that the tool member 292 may be detached and disengaged from the conduit 22. The tool member 292 may be changed to engage different ends into the conduit 22, or may be changed with the other tool members.

The shank 20 includes a shaft 23 extended from the other end thereof and having an outer thread 230 formed and provided on the outer peripheral portion thereof. A bucket 25 includes an inner thread 251 for threading onto the outer thread 230 of the shaft 23. A lock nut 24 is also threaded to the outer thread 230 of the shaft 23 and engaged with the bucket 25 for locking the bucket 25 to the shaft 23. The bucket 25 includes a bore 252 formed therein, and includes a peripheral flange 253 extended radially inward of the bore 252 thereof and extended from the free end thereof. The shaft 23 includes a free end having a socket opening 26 formed therein for receiving the tool members or the tool bits 30 to be driven by the shank 20, and includes a magnet or magnetic member 261 engaged therein for attracting and securing the tool bit 30 to the shaft 23.

Figure 5:
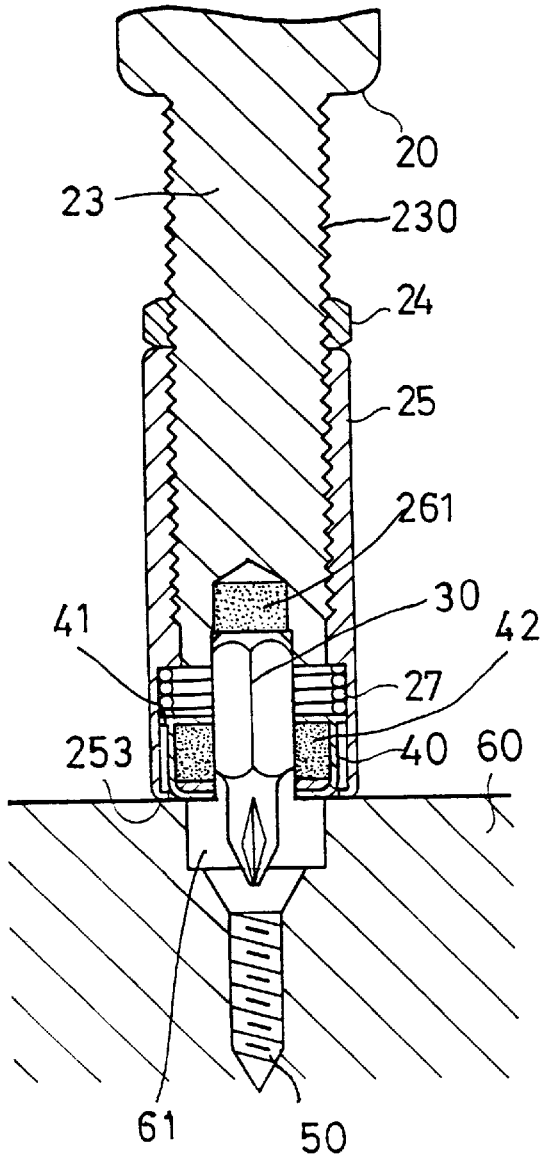

A casing 40 is slidably received in the bore 252 of the bucket 25 and includes a peripheral rib 41 extended radially outward from one end thereof for engaging with the peripheral flange 253 of the bucket 25 and for limiting the movement of the casing 40 relative to the bucket 25, and for preventing the casing 40 from being disengaged from the bucket 25. A spring 27 is engaged with the casing 40 for biasing the casing 40 outward of the bucket 25. A magnet 42 and a gasket 43 are engaged in the casing 40, and an orifice 401 is formed in the casing 40 and/or in the magnet 42, and/or in the gasket 43 for receiving the tool bit 30 and for allowing the tool bit 30 to be moved inward and outward of the casing 40 (FIGS. 3–7). As shown in FIG. 5, the casing 40 may be forced inward of the bucket 25 against the spring 27 when the casing 40 is engaged onto an object 60 and when the bucket 25 is forced toward the object 60.

Figure 6:
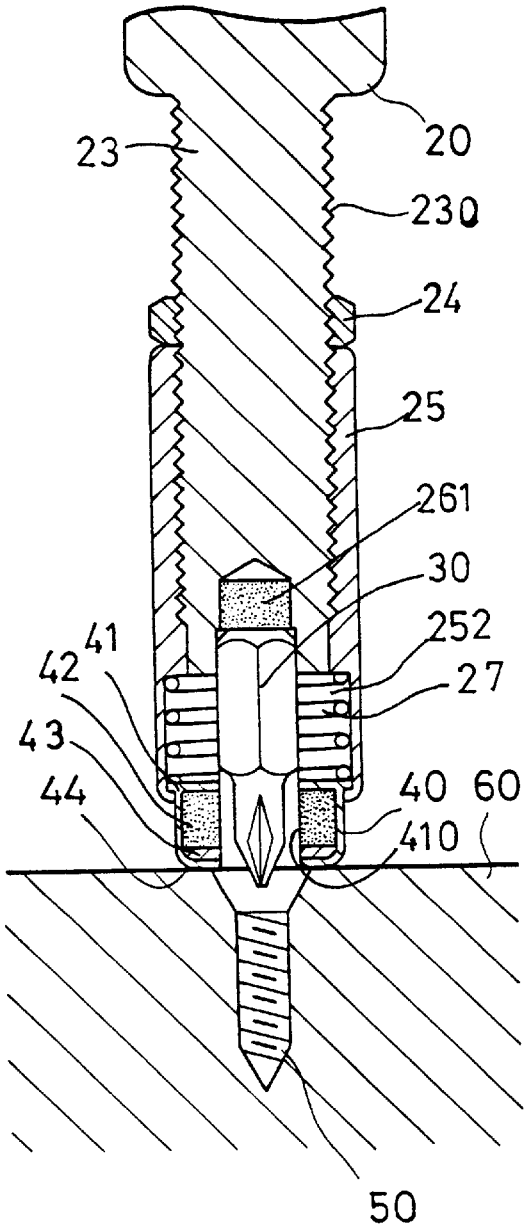
Figure 7:
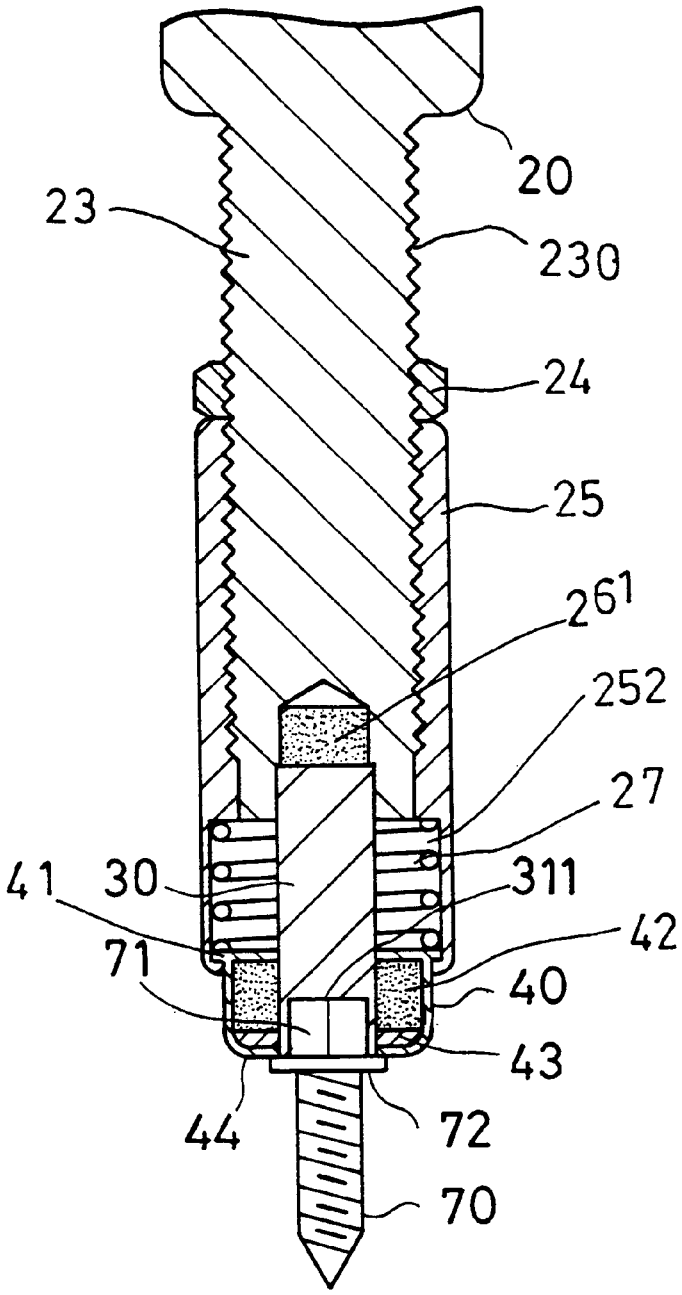

In operation, as shown in FIGS. 3–7, the bucket 25 may be rotated and adjusted relative to the shaft 23 for receiving the tool bits 30 of different or various lengths. The tool bits 30 may be stably attracted and retained in the casing 40 and the shaft 23 with the magnets 42, 261. The casing 40 includes an engaging surface 44 formed in the bottom or free end thereof for stably receiving the fasteners 50 of flat surfaces or curved surfaces. The tool bit 30 may be slightly moved outward of the casing 40 by engaging the casing 40 against the object 60 and by forcing the bucket 25 toward the object 60. The fastener 50 may thus be deeply engaged into a depression 61 of the object 60 (FIG. 5), or may be flatly engaged into the object 60 (FIG. 6). As shown in FIG. 7, the tool bit 30 may includes a cavity 311 formed therein for receiving a head 71 of a bolt 70 which has a peripheral panel 72 for engaging with the casing 40.

Accordingly, the tool retaining device in accordance with the present invention may be used for retaining or coupling various tool members to power driving tool and to be changeably driven by the power driving tool.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool retaining device comprising:

a shaft including a first end having a socket opening formed therein, a first tool member attached to said socket opening of said shaft, a bucket including a first end secured to said shaft and including a bore formed therein, and including a second end, said first tool member being received in said bore of said second end of said bucket, said bucket including a peripheral flange extended radially inward from said second end thereof, a casing slidably received in said second end of said bucket, and including a magnetic member engaged therein, and including an orifice formed therein for slidably receiving said first tool member, said first tool member being slidably engaged through said magnetic member and said casing and extendible outward of said casing, said casing including a peripheral rib extended radially outward therefrom for engaging with said peripheral flange of said bucket and for limiting a movement of said casing relative to said bucket and for preventing said casing from being disengaged from said bucket, and means for biasing said casing away from said bucket.

2. A tool retaining device comprising:

a shaft including a first end having a socket opening formed therein, a first tool member attached to said socket opening of said shaft, a bucket including a first end secured to said shaft and including a bore formed therein, and including a second end, said first tool member being received in said bore of said second end of said bucket, a casing slidably received in said second end of said bucket, and including a magnetic member engaged therein, and including an orifice formed therein for slidably receiving said first tool member, said first tool member being slidably engaged through said magnetic member and said casing and extendible outward of said casing, means for biasing said casing away from said bucket, and said shaft including a second magnetic member engaged in said socket opening thereof for retaining said first tool member to said shaft.

3. A tool retaining device comprising:

a shaft including a first end having a socket opening formed therein, said shaft including an outer thread formed therein, a first tool member attached to said socket opening of said shaft, a bucket including a first end secured to said shaft and including a bore formed therein, and including a second end, said first tool member being received in said bore of said second end of said bucket, said bucket including an inner thread threaded with said outer thread of said shaft, and a lock nut threaded onto said shaft and engaged with said bucket for locking said bucket to said shaft, a casing slidably received in said second end of said bucket, and including a magnetic member engaged therein, and including an orifice formed therein for slidably receiving said first tool member, said first tool member being slidably engaged through said magnetic member and said casing and extendible outward of said casing, and means for biasing said casing away from said bucket.

4. A tool retaining device comprising:

a shaft including a first end having a socket opening formed therein, a first tool member attached to said socket opening of said shaft, a bucket including a first end secured to said shaft and including a bore formed therein, and including a second end, said first tool member being received in said bore of said second end of said bucket, a casing slidably received in said second end of said bucket, and including a magnetic member engaged therein, and including an orifice formed therein for slidably receiving said first tool member, said first tool member being slidably engaged through said magnetic member and said casing and extendible outward of said casing, means for biasing said casing away from said bucket, a barrel, a shank including two ends selectively engaged in said barrel and including said shaft extended from a first end thereof, and means fo detachably securing said shank to said barrel.

5. The tool retaining device according to claim 4, wherein said shank includes an outer peripheral recess formed therein, said detachably securing means includes a ball slidably received in said barrel, and means for forcing said ball to engage with said outer peripheral recess of said shank.

6. The tool retaining device according to claim 5, wherein said forcing means includes a ferrule slidably engaged onto said barrel and engageable with said ball for forcing said ball to engage into said barrel and to engage with said outer peripheral recess of said shank.

7. The tool retaining device according to claim 6 further comprising means for biasing said ferrule to engage with said ball and to force said ball to engage with said shank.

8. The tool retaining device according to claim 4, wherein said shank includes a second end having a conduit extended thereon, said conduit includes an orifice formed therein, said tool retaining device further includes a second tool member engaged in said orifice of said conduit for being attached to said shank.

9. The tool retaining device according to claim 8, wherein said shank includes a second magnetic member engaged in said conduit for retaining said second tool member to said shank.

10. The tool retaining device according to claim 8 further comprising means for detachably securing said second tool member to said conduit.

11. The tool retaining device according to claim 10, wherein said detachably securing means includes a spring catch having a tongue slidably received in and engaged through said conduit, and means for forcing said tongue to engage with said second tool member.

12. The tool retaining device according to claim 11, wherein said forcing means includes a sleeve slidably engaged onto said conduit and engageable with said spring catch for forcing said tongue to engage into said conduit and to engage with said second tool member.

13. The tool retaining device according to claim 11, wherein said sleeve includes an actuator engageable with said spring catch for forcing said tongue to engage into said conduit and to engage with said second tool member.

14. The tool retaining device according to claim 13 further comprising means for biasing said actuator of said sleeve to engage with said tongue and to force said tongue to engage with said second tool member.

* * * * *